US008789614B2

(12) United States Patent
Hosfield

(10) Patent No.: US 8,789,614 B2
(45) Date of Patent: Jul. 29, 2014

(54) ULTRA-HIGH PRESSURE FIRE-FIGHTING SYSTEM

(75) Inventor: Robert L. Hosfield, Centerville, MN (US)

(73) Assignee: Fire Research Corp., Nesconset, NY (US)

( * ) Notice: Subject to any disclaimer, the term of this patent is extended or adjusted under 35 U.S.C. 154(b) by 44 days.

(21) Appl. No.: 12/427,561

(22) Filed: Apr. 21, 2009

(65) Prior Publication Data

US 2010/0065286 A1 Mar. 18, 2010

Related U.S. Application Data

(60) Provisional application No. 61/124,934, filed on Apr. 21, 2008.

(51) Int. Cl.
*A62C 35/00* (2006.01)

(52) U.S. Cl.
USPC ..... 169/14; 169/44; 169/13

(58) Field of Classification Search
CPC ..... A62C 3/06; A62C 3/065; A62C 5/002; A62C 5/02; A62C 5/022; A62C 27/00
USPC ..... 169/13, 15, 44, 46, 69, 66; 137/565.3; 417/3, 4, 5, 199.1, 201, 426
See application file for complete search history.

(56) References Cited

U.S. PATENT DOCUMENTS 2,543,941 A 3/1951 Sargent
2,696,266 A 12/1954 Tuve
3,103,891 A * 9/1963 Fulton et al. ..... 417/300
3,154,670 A 10/1964 Gossel
3,220,482 A 11/1965 Eveleth
3,239,148 A * 3/1966 Etnyre ..... 239/159
3,687,151 A 8/1972 Krause et al.
3,762,478 A 10/1973 Cummins
3,786,835 A * 1/1974 Finger ..... 137/565.3
3,786,869 A 1/1974 McLoughlin
3,814,541 A 6/1974 Dent et al.
3,974,879 A 8/1976 Nelson, Jr. et al.
4,037,664 A 7/1977 Gibson
4,047,665 A * 9/1977 Moynihan ..... 239/124
4,064,891 A 12/1977 Eberhardt
4,170,264 A 10/1979 Gibson
4,189,005 A 2/1980 McLoughlin
4,234,007 A 11/1980 Titone et al.
4,238,073 A * 12/1980 Liska ..... 239/127
4,246,969 A 1/1981 McLoughlin et al.
4,324,294 A 4/1982 McLoughlin et al.
4,436,487 A 3/1984 Purvis et al.
4,448,256 A 5/1984 Eberhardt et al.
5,035,580 A * 7/1991 Simonette ..... 417/34
5,255,747 A 10/1993 Teske et al.
5,397,054 A * 3/1995 Ziegs ..... 239/126
5,765,644 A 6/1998 Arvidson et al.

(Continued)

*Primary Examiner* — Dinh Q Nguyen
*Assistant Examiner* — Viet Le
(74) *Attorney, Agent, or Firm* — Quarles & Brady LLP

(57) ABSTRACT

Embodiments of the invention provide a fire-fighting system including a low-pressure system and an ultra-high pressure system (UHPS). The fire-fighting system can also include a foam proportioning system, which can inject a foamant into the low-pressure system and/or the UHPS. The low-pressure system and the UHPS can be simultaneously operated. Some embodiments of the fire-fighting system can be installed on aircraft rescue fire fighting (ARFF) vehicles.

24 Claims, 7 Drawing Sheets

(56) References Cited

U.S. PATENT DOCUMENTS

| | | | | |
|---|---|---|---|---|
| 6,082,630 | A * | 7/2000 | Bohrer | 239/127 |
| 6,357,532 | B1 | 3/2002 | Laskaris | |
| 6,684,959 | B1 * | 2/2004 | Juidici et al. | 169/44 |
| 6,991,041 | B2 * | 1/2006 | Laskaris et al. | 169/14 |
| 7,293,478 | B2 | 11/2007 | Kudo | |
| 7,318,483 | B2 | 1/2008 | Arvidson et al. | |
| 7,337,857 | B2 | 3/2008 | Vonhof et al. | |
| 2005/0196269 | A1 * | 9/2005 | Racer et al. | 415/62 |
| 2006/0266532 | A1 * | 11/2006 | Moskun | 169/62 |
| 2008/0099213 | A1 * | 5/2008 | Morrow et al. | 169/24 |

* cited by examiner

ULTRA-HIGH PRESSURE FIRE-FIGHTING SYSTEM

RELATED APPLICATIONS

This application claims priority under 35 U.S.C. §119 to U.S. Provisional Patent Application No. 61/124,934 filed on Apr. 21, 2008, the entire contents of which is incorporated herein by reference.

BACKGROUND

Aircraft rescue fire fighting (ARFF) vehicles are used to extinguish fires occurring at civilian airports and military airfields. The ARFF vehicles are often used as military crash rescue equipment. FIG. 1 illustrates an ARFF vehicle 10 including a body 12, tires 14, a roof turret 16, and a bumper turret 18. Because of the remote location of runways and the size of the aircraft, the ARFF vehicle 10 typically carries a large amount of water and foamant onboard. The roof turret 16 and the bumper turret 18 are used to extinguish the fire, while the ARFF vehicle 10 is moving to enable a fast first response, called a "pump and roll" operation. Fire extinguishing systems of the ARFF vehicle 10 are generally capable of operating at pressures ranging from 100 to 300 PSI requiring high flow rates of water and foamant. To satisfy these high flow rates, the ARFF vehicle 10 generally carries 1,000 gallons of water and an additional 130 gallons of foamant. Because of the volume and the weight of the onboard water and foamant, the body 12 and the tires 14 are typically larger than on fire trucks used for residential fires. Additionally, the ARFF vehicle 10 includes an elevated ground clearance 20 in order to pass over debris surrounding the crash site.

The size of the ARFF vehicle 10 can become a problem when the ARFF vehicle must be transported on cargo aircrafts, such as a C130. In order to be transported in a cargo aircraft, the air pressure in the tires 14 must be lowered and the turrets 16, 18 must be removed. Even then, only one ARFF vehicle 10 at a time can be transported.

SUMMARY

Embodiments of the invention provide a fire-fighting system including a low-pressure system and an ultra-high pressure system (UHPS). The fire-fighting system can also include a foam proportioning system, which can inject a foamant into the low-pressure system and/or the UHPS. The low-pressure system and the UHPS can be simultaneously operated. Some embodiments of the fire-fighting system can be installed on aircraft rescue fire fighting (ARFF) vehicles.

DETAILED DESCRIPTION

Figure 1:
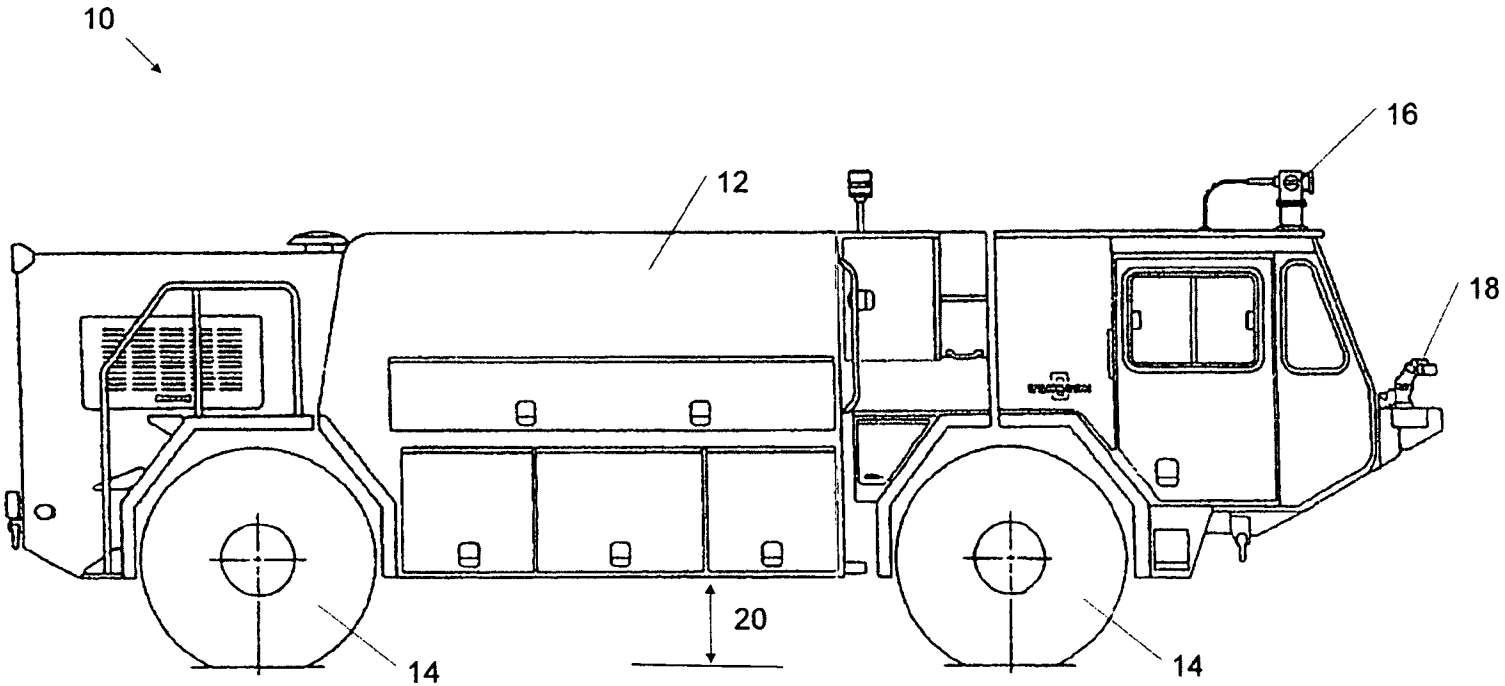
FIG. 1 (PRIOR ART)
FIG. 1 is a side view of an ARFF vehicle demonstrating the state of the art.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 2:
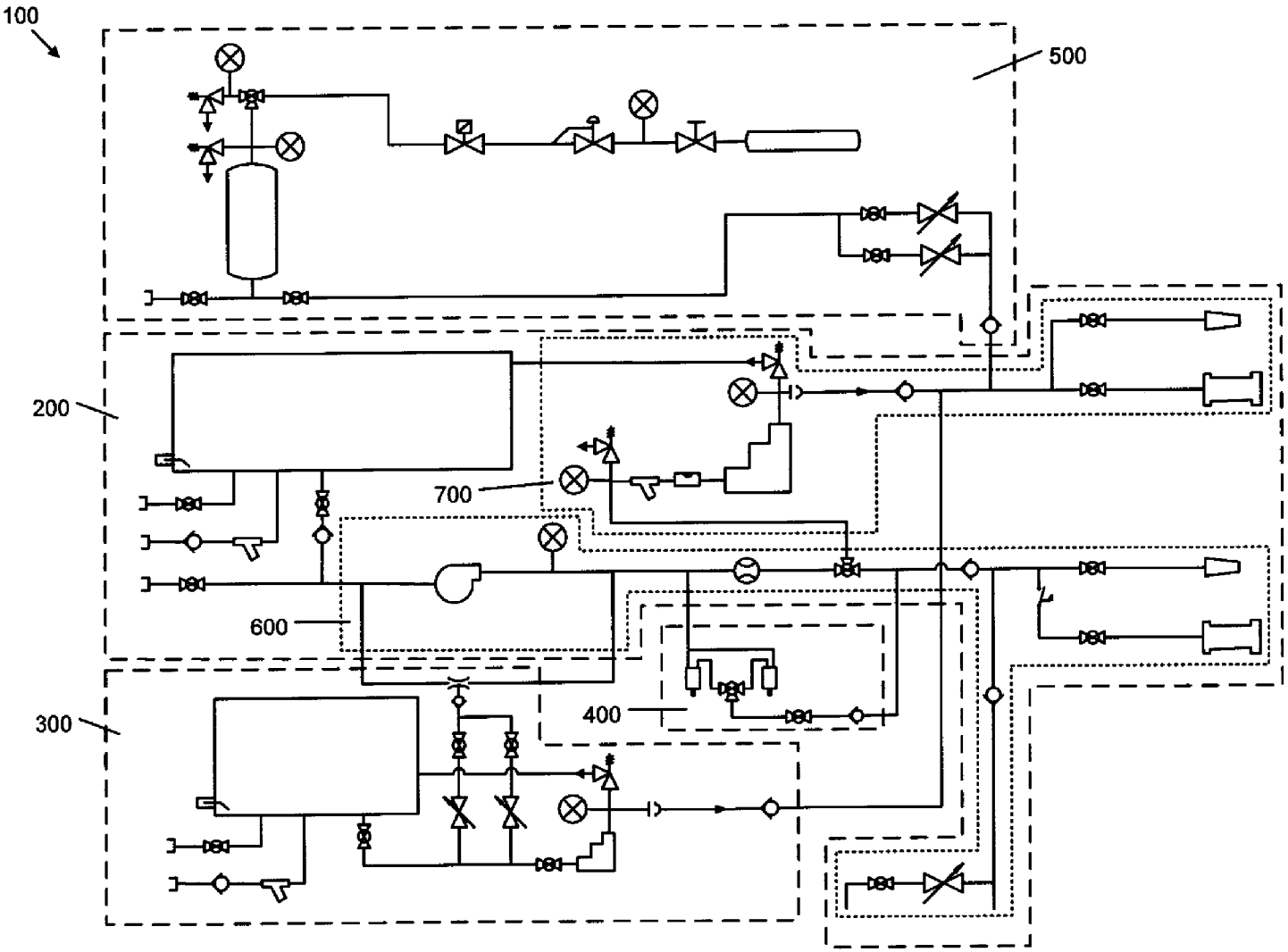
FIG. 2 is a schematic diagram of a fire fighting system according to one embodiment of the invention.

FIG. 2 illustrates a fire fighting system 100 according to one embodiment of the invention. The fire fighting system 100 can include a water supply system 200, a foam proportioning system (FPS) 300, a compressed air foam system (CAFS) 400, and a cleaning agent system 500. The water supply system 200 can include a low-pressure system 600 and an ultra-high pressure system (UHPS) 700.

Figure 3:
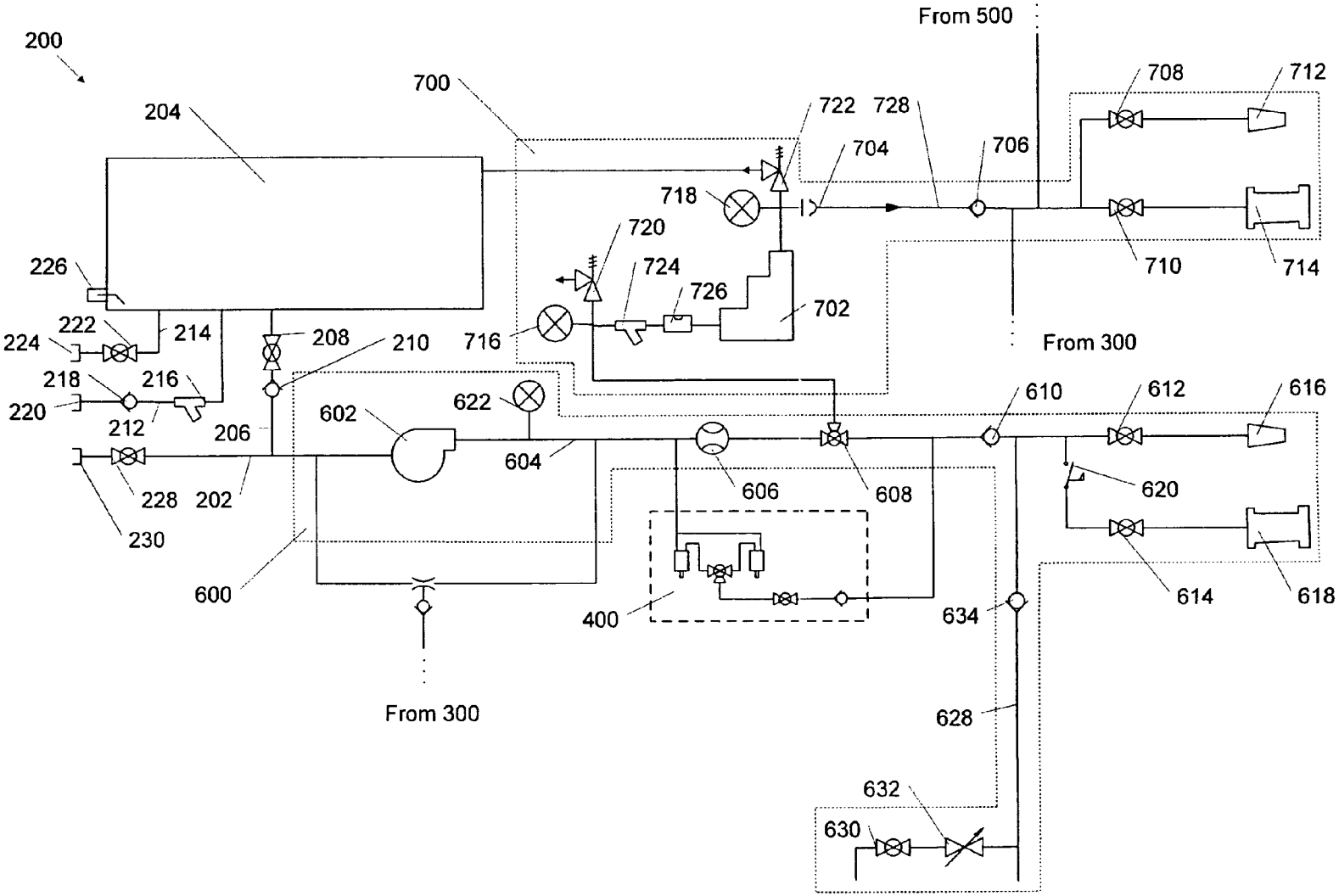
FIG. 3 is a schematic diagram of a water supply system of the fire fighting system of FIG. 2.

FIG. 3 illustrates the water supply system 200 according to one embodiment of the invention. The water supply system 200 can further include an inlet line 202 and a water tank 204. The water tank 204 can connect to the inlet line 202 via a conduit 206. The conduit 206 can include a first ball valve 208 and a first check valve 210. The water tank 204 can also include a fill line 212 and a drain line 214. The fill line 212 can include a first line strainer 216, a second check valve 218, and a first inlet coupling 220. The drain line 214 can include a second ball valve 222 and an outlet coupling 224.

For filling the water tank 204, a hose or other conduit can be connected to the first inlet coupling 220 to supply a water stream. The second check valve 218 can allow the water stream to enter the water tank 204. If the water stream is stopped, the second check valve 218 can automatically close so that supplied water can be stored in the water tank 204. The drain line 214 can be used to completely empty the water tank 204. The second ball valve 222 can be opened to allow a water stream to exit through the outlet coupling 204. A hose or other conduit can connect to the outlet coupling 224 to facilitate draining of the water tank 204. In some embodiments, the water tank 204 can include a water level sensor 226, which can notify an operator about a remaining water quantity in the water tank 204.

The inlet line 202 can supply a water stream to the low pressure system 600 and the UHPS 700. The inlet line 202 can include a third ball valve 228 and a second inlet coupling 230. The third ball valve 228 can be normally closed. The second inlet coupling 230 can be used to draw water from a hydrant and/or other municipal source after the third ball valve 228 has been opened. In some embodiments, supplying water through the second inlet coupling 230 can be a back up system and the water tank 204 can be the main source of water for the fire fighting operation.

The low-pressure system 600 can include a centrifugal pump 602, a supply line 604, a first flow meter 606, a first selector valve 608, a third check valve 610, a fourth ball valve 612, a fifth ball valve 614, a first turret 616, a first hand nozzle 618, and a fluid switch 620. In one embodiment, the inlet line 202 can be directly coupled to an inlet of the centrifugal pump 602. The centrifugal pump 602 can increase the pressure from the inlet line 202 to the supply line 604. A first pressure gauge 622 can provide information about the pressure in the supply line 604. The supply line 604 can provide a fluid flow to the first turret 616 and the first hand nozzle 618, through which the fluid can exit the fire-fighting system 100. The supply line 604 can also be called a first discharge line.

In some embodiments, the first flow meter 606 can be a paddle wheel flow meter. The first flow meter 606 can generate a signal representing a flow rate through the supply line 604. The signal generated by the first flow meter 606 can represent the flow rate over substantially the entire range of flow rates of the fire-fighting system 100. In one embodiment, the first flow meter 606 can be installed along the supply line 604 where turbulence inside the supply line 604 is as minimal as possible.

An additional supply line 628 can be used to supply flow to the first turret 616 and/or the first hand nozzle 618. The additional supply line 628 can include a sixth ball valve 630, a first gate valve 632, and a fourth check valve 634. The sixth ball valve 630 can act as a shut-off valve. The first gate valve 632 can be used to regulate the fluid flow through the additional supply line 628. The fourth check valve 634 can prevent a back flow from the supply line 604 into the additional supply line 628. The additional supply line 628 can supplement the supply line 604. The additional supply line 628 can also carry a pressurized fluid from another source. Examples of other sources include conventional fire trucks, tank trailers, and another ARFF vehicle. The fluid supplied to the additional supply line 628 can include water and foamant.

The UHPS 700 can include a high-pressure pump 702, a first burst disc 704, a fifth check valve 706, a seventh ball valve 708, an eighth ball valve 710, a second turret 712, and a second hand nozzle 714. In some embodiments, the high-pressure water pump 702 can be hydraulically driven. In some embodiments, the high-pressure water pump 702 can include more than one pump. In some embodiments, one of the pumps can normally operate and additional pumps can be activated based on a flow demand of the UHPS 700. In other embodiments, at least one pump can satisfy a maximum demanded flow rate of the UHPS 700 and additional pumps can be activated based on a desired pressure of the UHPS 700. In one embodiment, the high-pressure water pump 702 can include three staged plunger pumps.

The UHPS 700 can include a second pressure gauge 716, a third pressure gauge 718, a second pressure relief valve 720, a third pressure relief valve 722, a second line strainer 724, and a pressure switch 726. The UHPS 700 can receive water from the supply line 604 through the first selector valve 608. In some embodiments, the centrifugal pump 602 can act as a pre-stage pump for the high-pressure water pump 702. The pressure switch 726 can reduce a pressure upstream of the high-pressure water pump 702, if the pressure of the water received from the supply line 604 is too high. As a result, the UHPS 700 can be activated independent of a water pressure in the inlet line 202.

A water stream coming from the first selector valve 608 and entering the UHPS 700 can flow through the second pressure relief valve 720, the second line strainer 724, and the pressure switch 726 before entering the high-pressure pump 702. The second line strainer 724 can prevent foreign particles from entering and possibly damaging the high-pressure water pump 702. The second pressure gauge 716 can indicate a pressure of the water upstream of the high-pressure water pump 702, while the third pressure gauge 718 can indicate a pressure downstream of the high-pressure water pump 702. The high-pressure water pump 702 can force the water stream through a second discharge line 728, which can connect the high-pressure water pump 702 with the second turret 712 and/or the second hand nozzle 714. The second discharge line 728 can carry the water stream through the first burst disc 704 and the fifth check valve 706, before the water stream can be routed to the second turret 712 and the second hand line 714. The seventh ball valve 708 can meter a flow through the second turret 712 and the eighth ball valve 710 can meter a flow through the second hand nozzle 714. In some embodiments, the seventh ball valve 708 and the eighth ball valve 710 can include a fully-closed position and one or more open positions.

The third pressure relief valve 722 can route a portion of the water stream through the high-pressure water pump 702 back into the water tank 204, if the pressure downstream of the high-pressure pump 702 exceeds a specific pressure. In some embodiments, the third pressure relief valve 722 can be opened in order to route water back into the water tank 204, if there is a decrease in flow demand (e.g., by closing at least one of the seventh ball valve 708 and the eighth ball valve 710 and stopping flow through the second turret 712 and/or the second hand nozzle 714). The first burst disc 704 can act as a safety device and can release the pressure from the second discharge line 728 if the third pressure relief valve 722 fails. The fifth check valve 706 can prevent flow from downstream of the fifth check valve 706 toward the third pressure relief valve 722, so that only water can enter the water tank 204, if the third pressure relief valve 722 is opened.

Figure 4A:
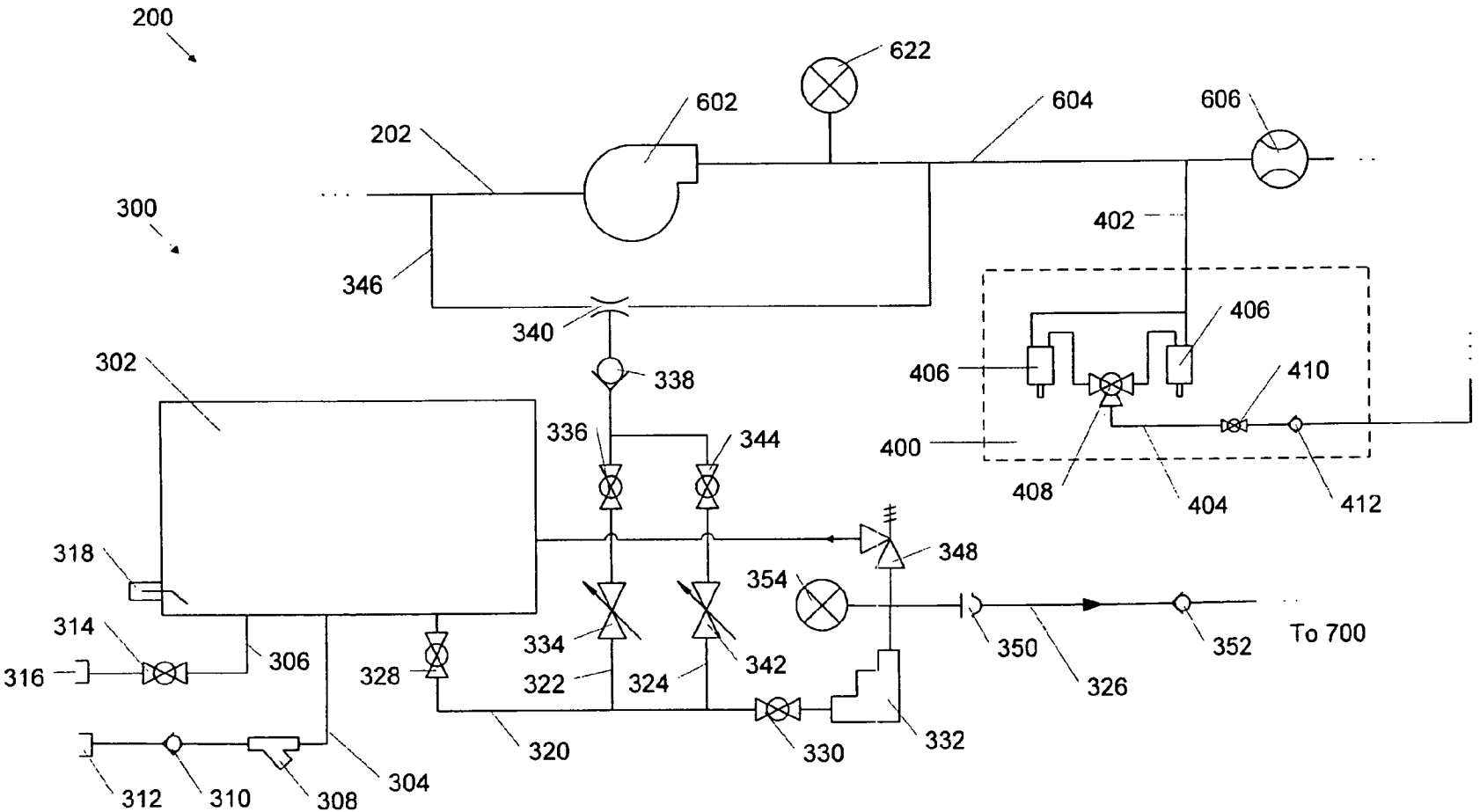
FIG. 4A is a schematic diagram of a foam proportioning system according to one embodiment of the invention.

FIG. 4A illustrates the FPS 300 according to one embodiment of the invention. The FPS 300 can include a foam tank 302, a foam fill line 304, and a foam drain line 306. The foam fill line 304 can include a third line strainer 308, a sixth check valve 310, and a foam inlet 312. Foamant coming from the foam inlet 312 can pass through the third line strainer 308 to remove any particles, which can negatively influence the performance of the FPS 300. The sixth check valve 310 can prevent the foamant from flowing out of the foam inlet 312. The drain line 306 can include a ninth ball valve 314 and a foam outlet 316. The ninth ball valve 314 can substantially act as a shut-off valve and can be normally closed. The ninth ball valve 314 can be opened to drain the foamant from the foam tank 302. In some embodiments, the drain line 306 can drain substantially all the foamant from the foam tank 302. The FPS 300 can be flushed to wash out corrosive types of foamant in order to help provide a prolonged life cycle of the FPS 300. Flushing the FPS 300 may not require draining the foamant from the foam tank 302.

In some embodiments, a foam level sensor 318 can generate a signal if the foamant inside the foam tank 302 has dropped below a certain value. In other embodiments, the foam level sensor 318 can generate a signal in relation to a level of the foamant inside the foam tank 302.

The FPS 300 can include a foam supply line 320, a first low-pressure foam line 322, a second low-pressure foam line 324, and a high-pressure foam line 326. The foam supply line 320 can include a tenth ball valve 328, an eleventh ball valve 330, and a foam pump 332. In some embodiments, the foam supply line 320 can route the foamant from the foam tank 302 through the tenth ball valve 328 to the first low-pressure foam line 322, the second low-pressure foam line 324, the eleventh ball valve 330, and the foam pump 332. To minimize the possibility of a rupture of the foam supply line 320 due to vibrations of the foam pump 332, the foam supply line 320 can include at least one flexible portion upstream of the foam pump 332. The foam supply line 320, the first low-pressure foam line 322, the second low-pressure foam line 324, and the high pressure foam 326 can be installed in such a way that abrasion and/or chafing can be minimized during the operation of the FPS 300. The tenth ball valve 328 can prevent the foamant from entering the foam supply line 320. The eleventh ball valve 330 can prevent the foamant from entering the foam pump 332.

The first low-pressure foam line 322 can include a second gate valve 334, a twelfth ball valve 336, a seventh check valve 338, and an inductor 340. The second low-pressure foam line 324 can include a third gate valve 342 and a thirteenth ball valve 344. The second gate valve 334 and the third gate valve 342 can regulate the amount of the foamant flowing through the first low-pressure foam line 322 and the second low-pressure foam line 324, respectively. In some embodiments, the second gate valve 334 and the third gate valve 342 can allow different flow rates of the foamant to be injected in the low-pressure system 600. The twelfth ball valve 336 and the thirteenth ball valve 344 can inhibit or allow a flow of the foamant through the first low-pressure foam line 322 and the second low-pressure foam line 324, respectively.

The inductor 340 can be positioned along a foam injection line 346. The inductor 340 can be a venturi nozzle. In some embodiments, the foam injection line 346 can route fluid around the centrifugal pump 602 and can connect the supply line 604 back to the inlet line 202. The foam injection line 346 can also be called an "around the pump" (ATP) line. Fluid can circulate from the supply line 604 through the foam injection line 346 back to the inlet line 202. The fluid flowing through the foam injection line 346 can experience a pressure drop over the inductor 340, thereby drawing the foamant into the foam injection line 346. In some embodiments, the inductor 340 can be designed so that the pressure substantially recovers quickly downstream of the inductor 340. The seventh check valve 338 can prevent the water stream in the foam injection line 346 from entering the first low-pressure foam line 322.

Figure 4B:
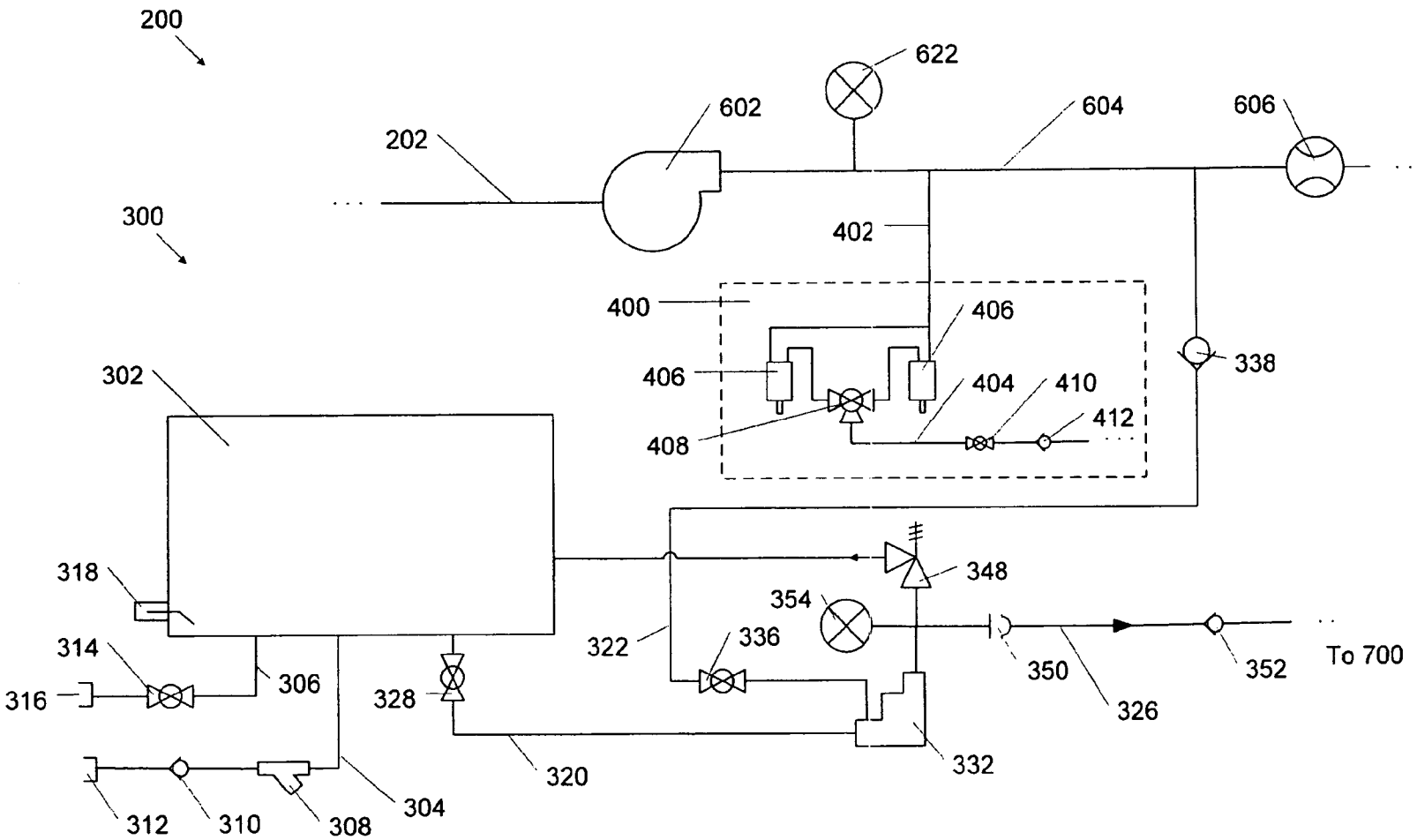
FIG. 4B is a schematic diagram of a foam proportioning system according to another embodiment of the invention.

FIG. 4B illustrates the FPS 300 according to another embodiment of the invention. As described in the U.S. Reissue Pat. No. 35,362 issued to Arvidson et al., which is hereby incorporated by reference in its entirety, the FPS 300 can include a positive displacement pump. The positive displacement pump can be used to automatically proportion the foamant in the concentration required for the specific fire-fighting operation, but without overusing and wasting the foamant. U.S. Pat. No. 6,886,639 issued to Arvidson et al., which is also hereby incorporated by reference in its entirety, expanded on the above concepts by disclosing a foam proportioning system that permits foam concentrate from a single storage tank to be injected into several water discharge lines, in which the water flow rate through the individual lines can drastically vary. In some embodiments, the positive displacement pump can be part of the foam pump 332. The first low-pressure foam line 322 can carry an amount of the foamant pumped by the positive displacement pump to the supply line 604. The first low-pressure foam line 322 can connect to the supply line 604 upstream or downstream of the first flow meter 606. A static mixer can enhance the mixing of the foamant with the water stream in the supply line 604. As a result, a homogenous water-foamant solution can be delivered to the first turret 616 and/or the first hand nozzle 618.

In some embodiments, the foam pump 332 can be driven by an electric motor. A combination of rotor speed, rotor torque, and rotor angle of the electric motor can be used to calculate a flow rate through the foam pump 332. If the foam pump 332 includes a piston, the position of the piston can determine the speed at which the positive displacement pump can be driven, as is described in U.S. Pat. No. 6,577,089 issued to Piedl et al., which is hereby incorporated by reference in its entirety. If a flow rate of the foamant for the low-pressure system 600 exceeds the maximum flow rate that can be achieved by the electric motor, the foam pump 332 can be capable of supporting the injection of the foamant into the low-pressure system 600. Some embodiments can include a system as described in U.S. Pat. No. 5,494,112 issued to Arvidson et al., which is also hereby incorporated by reference in its entirety, where an electrically-driven pump can be used to inject the foamant into the low-pressure system 600 and a hydraulically-driven pump can be used to inject the foamant into the UHPS 700. In some embodiments, the electric motor can be a servo motor, which can provide high torque values down to substantially zero RPM.

In some embodiments, a CAFS 400 can introduce an amount of compressed air into the supply line 604. The CAFS 400 can include a sensor line 402, an injection line 404, and a compressor 406. In some embodiments, two or more compressors 406 can be connected to the injection line 404 by a second selector valve 408. The sensor line 402 can be used to measure a pressure in the supply line 604. The compressor 406 can be activated upon the measured pressure. The injection line 404 can include a fourteenth ball valve 410 and an eighth check valve 412. The fourteenth ball valve 410 can regulate the amount of air being introduced into the supply line 604. The eighth check valve 412 can prevent fluid from the supply line 604 from entering the CAFS 400. In some embodiments, the injection line 404 can connect to the supply line 604 downstream of the first selector valve 608 and upstream of the third check valve 610.

In some embodiments, the high-pressure foam line 326 can include a fourth pressure relief valve 348, a second burst disc 350, and a ninth check valve 352. The high-pressure foam line 326 can connect to an outlet of the foam pump 332. In some embodiments, the foam pump 332 can be hydraulically driven. In some embodiments, the foam pump 332 can include more than one pump. In some embodiments, at least one of the pumps can normally operate and additional pumps can be activated based on a flow rate of the UHPS 700. In other embodiments, one pump of the pumps can satisfy a maximum demanded flow rate of the FPS 300 and additional pumps can be activated based on a desired pressure of the FPS 300. In one embodiment, the foam pump 332 can include plunger pumps and/or diaphragm pumps. In some embodiments, the flow rate of the foamant through the foam pump 332 can be proportional to the speed at which the foam pump 332 is driven. In other embodiments, the foam pump 332 can include a variable pumping volume. A fourth pressure gauge 354 can indicate a pressure in the high-pressure foam line 326.

The foamant leaving the foam pump 332 can flow through the second burst disc 350 and the ninth check valve 352 before entering the UHPS 700. The ninth check valve 352 can prevent the water stream from the UHPS 700 from entering the FPS 300. The high-pressure foam line 326 can connect to the UHPS 700 downstream of the fifth check valve 706 to prevent the foamant from flowing back into the UHPS 700.

The injection of the foamant into the UHPS 700 can occur at substantially balanced pressures. In some embodiments, the foamant flowing through the high-pressure foam line 326 can be at a higher pressure than the water stream of the UHPS 700 to help the mixing of the foamant into the water stream to create a water-foamant solution. Although most foamants mix with the water stream rather quickly, a static mixer can enhance the mixing of the foamant with the water stream. As a result, a homogenous water-foamant solution can be delivered to the second turret 712 and/or the second hand nozzle 714.

If the pressure in the high-pressure foam line 326 exceeds a certain threshold, the fourth pressure relief valve 348 can open and can route a portion of the foamant back into the foam tank 302. If the fourth pressure relief valve 348 fails, the second burst disc 350 can release the pressure of the high-pressure foam line 326. The fourth pressure relief valve 348 can also be used to route foamant back into the foam tank 302, if a sudden change in flow demand occurs (e.g., when the second turret 712 and/or the second hand nozzle 714 are closed). Routing the foamant back into the foam tank 302 (rather than to the foam supply line 320) can result in a minimized aerating of the foamant, which results in more accurate foam flow rates.

Figure 5:
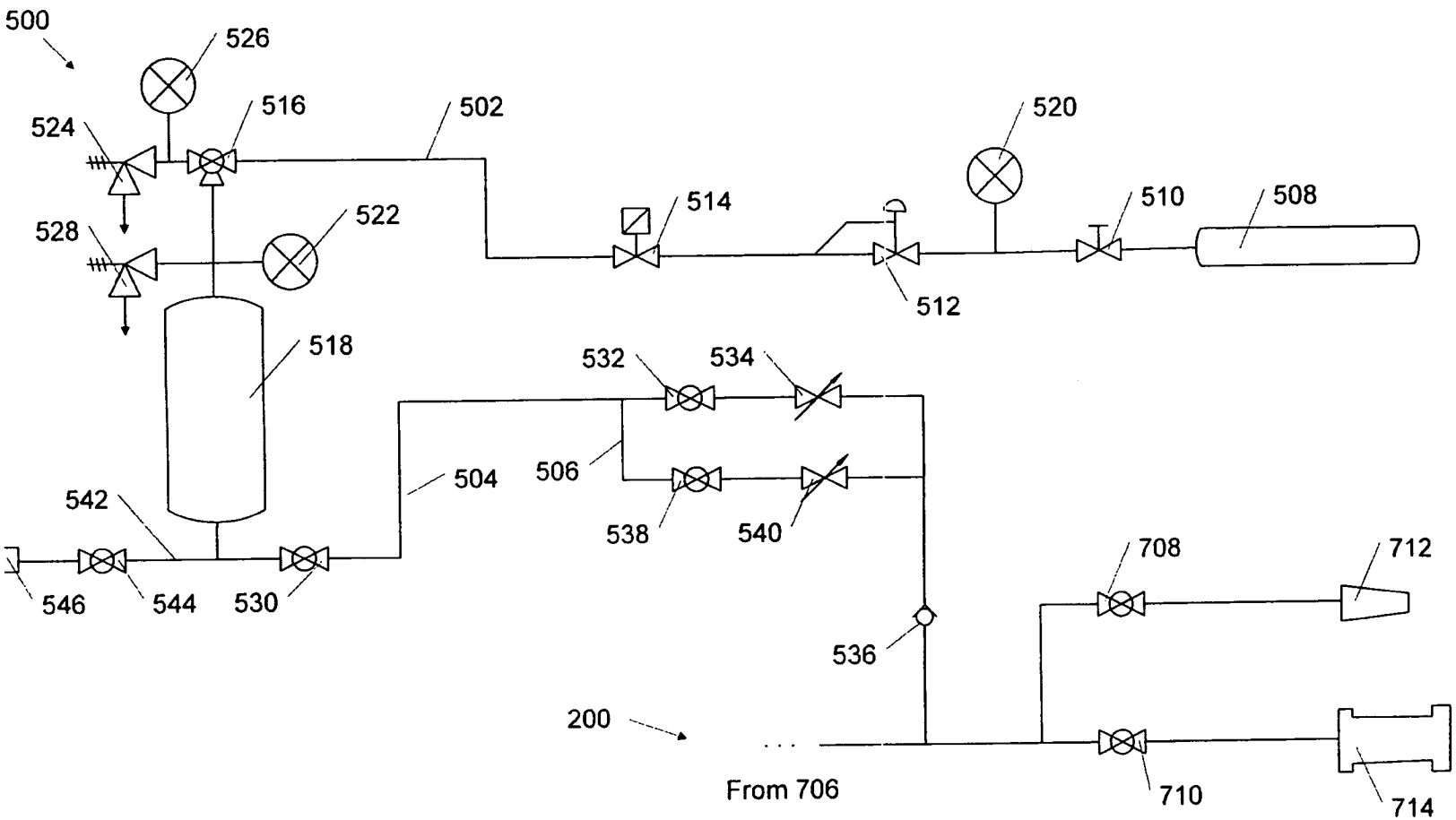
FIG. 5 is a schematic diagram of a cleaning agent system of the fire fighting system of FIG. 2.

FIG. 5 illustrates a cleaning agent system 500 according to one embodiment of the invention. The cleaning agent system 500 can be used to decontaminate an area and to eject a cleaning agent into the UHPS 700 for extinguishment. The cleaning agent can be a dry chemical, such as a powder. The cleaning agent system 500 can include an air supply line 502, a primary supply line 504, and a secondary supply line 506. The cleaning agent system 500 can further include an air tank 508, a globe valve 510, a fifth pressure relief valve 512, a solenoid valve 514, a third selector valve 516, and a cleaning agent tank 518. The air tank 508 can be pressurized. In some embodiments, the pressure in the air tank 508 can be substantially higher than the pressure in the UHPS 700. The globe valve 510 can connect the air tank 508 with the air supply line 502. A fifth pressure gauge 520 can indicate the pressure in the air supply line 502.

The third selector valve 516 can connect the cleaning agent tank 518 and the air supply line 502. A sixth pressure gauge 522 can indicate the pressure of the air entering the cleaning agent tank 518. The third selector valve 516 can also connect to a sixth pressure relief valve 524, to which a seventh pressure gauge 526 can be connected in order to indicate a pressure of the air between the third selector valve 516 and the sixth pressure relief valve 524.

In some embodiments, air coming from the air tank 508 can push the cleaning agent out of the cleaning agent tank 518 into the primary supply line 504. A seventh pressure relief valve 528 can be positioned between the third selector valve 516 and the cleaning agent tank 518. The seventh pressure relief valve 528 can be used to relieve a pressure of the cleaning agent tank 518.

In some embodiments, the primary supply line 504 can include a fifteenth ball valve 530, a sixteenth ball valve 532, a fourth gate valve 534, and a tenth check valve 536. The fifteenth ball valve 530 can act as shut-off valve and can prevent the cleaning agent from entering the primary supply line 504. The secondary supply line 506 can include a seventeenth ball vale 538 and a fifth gate valve 540. An inlet of the secondary supply line 506 can connect to the primary supply line 504 upstream of the sixteenth ball valve 532 and an outlet of the secondary supply line 506 can connect to the primary supply line 504 downstream of the fourth gate valve 534. As a result, the sixteenth ball valve 532 and the seventeenth ball valve 538, as well as the fourth gate valve 534 and the fifth gate valve 540, can be in parallel with respect to each other, as shown in FIG. 5. The primary supply line 504 and the secondary supply line 506 can be used to introduce the cleaning agent at different flow rates into the UHPS 700. The fourth gate valve 534 and the fifth gate valve 540 can be calibrated to allow a specific flow rate. The fifteenth ball valve 530 and the seventeenth ball valve 538 can be used to route the cleaning agent through the primary supply line 504 and/or the secondary supply line 506.

The cleaning agent system 500 can further include a supplement line 542, which can connect to the primary supply line 504. The supplement line 542 can include a eighteenth ball valve 544 and a coupling 546. The eighteenth ball valve 544 can act as a shut-off valve and can be normally closed. If open, additional cleaning agent can be supplied to the primary supply line 504 through the coupling 546. The supplement line 542 can be used to drain the cleaning agent tank 518, if the fifteenth ball valve 530 is closed and the eighteenth ball valve 544 is open.

Figure 6:
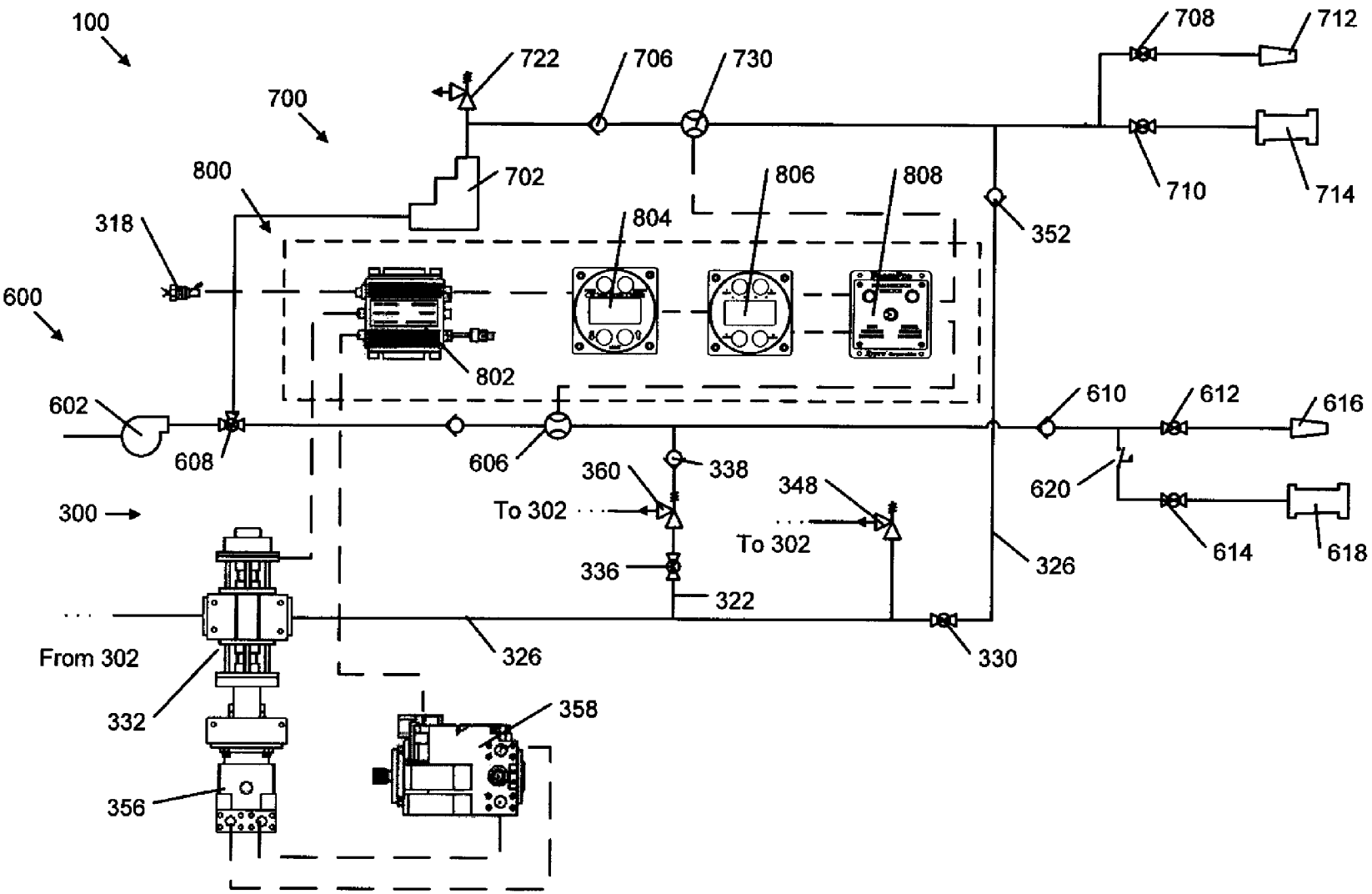
FIG. 6 is a schematic diagram of the fire fighting system including a control system according to one embodiment of the invention.

FIG. 6 illustrates the fire-fighting system 100 according to another embodiment of the invention. The foam pump 332 can operate over a range of pressures and flow rates suitable to deliver the foamant to the low-pressure system 600 and the UHPS 700. As a result, the foam pump 332 can be located along the foam supply line 320 and can be positioned upstream of the first low-pressure foam line 322. The foam pump 332, can include a hydraulic motor 356, which can be driven by a hydraulic supply pump 358.

FIG. 6 further illustrates a control system 800 for the FPS 300 according to one embodiment of the invention. The control system 800 can include a driver 802, a control display 804, a Multi-Flo system 806, and an injector selector 808. The driver 802 can connect to the control display 804, which can be used to display information and status reports about the FPS 300. The control display 804 can be used to communicate operating parameters and user input to the driver 802. For example, the control display 804 can compute the required speed of the foam pump 332 to deliver the proper amount of the water-foamant solution and send a related signal to the driver 802. The Multi-Flo system 806 can connect to the control display 804 and the injector selector 808 can be connected to the Multi-Flo system 806.

The control display 804 can include a microprocessor, memory, and other suitable equipment (e.g., A/D and D/A converters) in order to store and execute control derivative for the FPS 300. In some embodiment, the control system 800 can be operated with the electrical system of the ARFF vehicle. In one embodiments, the control system 800 can be operated on 24 Volts direct current ($V_{DC}$). The control system 800 can be grounded, and in some embodiments, the wire to ground the ground system 800 can be a braided flat strap minimizing the radio frequency interference (RFI) and the electromagnetic interference (EMI) encountered with radios, computers and other sensitive electronic equipment.

In some embodiments, the UHPS 700 can include a second flow meter 730. The first flow meter 606 and the second flow meter 730 can send a signal to the injector selector 808. The signal can represent a flow rate of the respective fluid stream, and the signal can be transmitted to the control display 804. The first flow meter 606 can be positioned upstream or downstream of the low-pressure foam line 322. The second flow meter 730 can be positioned upstream or downstream of the high-pressure foam line 326. As a result, the flow of the water stream alone or the flow rate of the water-foamant solution can be used to operate the FPS 300.

The control display 804 can calculate a foam flow rate at which the foamant from the foam tank 302 should be injected into the low-pressure system 600 and the UHPS 700. The foam pump 332 can send a speed signal to the driver 802. In one embodiment, a four-pin speed sensor (e.g., one sold by Sauer-Sundstrand) can be included in the foam pump 332. The control display 804 can use the speed signal to compute a flow rate of the foamant. In some embodiments, the control display 804 can change the speed of the foam pump 332 according to a selected concentration of the water-foamant solution and the respective water flow rate. In some embodiments, the driver 802 can change a current supplied to the hydraulic supply pump 358 to vary the speed of the foam pump 332. In other embodiments, a voltage supplied to the hydraulic supply pump 358 can be used to vary the speed of the foam pump 332.

In some embodiments, the control display 804 can operate the foam pump 332 according to the total foam flow rate of the FPS 300. The first low-pressure foam line 322 can connect to the high-pressure foam line 326 downstream of the foam pump 332. The first low-pressure foam line 322 can include the twelfth ball valve 336, an eighth pressure release valve 360, and the seventh check valve 338. The control system 800 can operate at least the twelfth ball valve 336 to meter the foam flow rate to the low-pressure system 600. The eighth pressure release valve 360 can reduce a pressure in the first low-pressure foam line 322 and can route foamant back to the foam tank 302. If the total foam flow rate in the FPS 300 is below a minimum flow rate, which can be achieved by the foam pump 332, the fourth pressure relief valve 348 can route excessive pump foamant back into the foam tank 302. As a result, the control system 800 can achieve individual foam flow rates to the low-pressure system 600 and the UHPS 700.

In some embodiments, the control system 800 can include an auto-start feature, which can operate the FPS 300 upon detection of a water flow rate in the water supply system 200. In some embodiments, the control system 800 can operate two or more components simultaneously. For example, the control system 800 can adjust the foam flow rate in the FPS 300 and control the addition of air in the CAFS 400. In some embodiments, the control system 800 can include a single control display 804, while in other embodiments, the control system 800 can include two or more controllers.

In some embodiments, at least one of the low-pressure system 600 and the UHPS 700 can include two or more discharge lines carrying water streams for the fire-fighting operation. The Multi-Flo system 806 can allow individual foam proportioning for at least two of the plurality of discharge lines. The Multi-Flo system 806 can be responsible for coordinating the injection of the foamant into the low-pressure system 600 and the UHPS 700. The Multi-Flo system 806 can monitor individual foam flow rates and can compare them with desired foam flow rates. The Multi-Flo system 806 can adjust the foam flow rates for the low-pressure system 600 and the UHPS 700 so that the desired foam flow rate, i.e. the selected concentration, can be accurately fulfilled for the low-pressure system 600 and the UHPS 700. In some embodiments, the Multi-Flo system 806 can substantially constantly monitor the individual foam flow rate and can adjust the foam flow rate with respect to variations in the water flow rate. The Multi-Flo system 806 can allow an individual calibration of the connected flow meters, for example, as shown in FIG. 6, the first flow meter 606 and the second flow meter 730. In some embodiments, the total sum of the delivered foamant can be transmitted to the control display 804 so that the operator can estimate the remaining foamant in the foam tank 302. In some embodiments, the total sum of foam flow rates can be transmitted to the control display 804, which can use this information to operate at least the foam pump 332.

In some embodiments, the FPS 300 can include two or more foam tanks 302. In one embodiment, the foam tanks 302 can be used to store different types of foamant for the FPS 300. In other embodiments, the foam tanks 302 can connect to the discharge lines. For example, one of the foam tanks 302 can store the foamant to be injected into the low-pressure system 600, while another one of the foam tanks 302 can store the foamant to be injected in the UHPS 700.

As shown in FIG. 6, the foam level sensor 318 can communicate a signal representing a low amount of foamant to the driver 802, which can provide a warning message on the control display 804. The controller can process additional sensor inputs of components of the fire-fighting system 100 to monitor its status. In some embodiments, the control display 804 can also monitor a temperature of the foam pump 332 and a water level in the water supply tank 204. The control display 804 can display a warning message, which can be uniquely identifiable with respect to the detected error by the control display 804.

The ball valves described herein can be pneumatically, electrically, and/or manually operated. The pneumatically-operated ball valves can be shut-off valves having a fully-open position and a fully-closed position. The electrically operated ball valves can be servo valves (e.g., those sold by Sauer-Sundstrand). The control system 800 can include an electrical displacement control (EDC) for operating the electrical ball valves. The electrical ball valves can provide feedback to the control system 800 regarding their position. The pneumatic and the electric ball valves can include a handle for manual operation in case of a failure or insufficient power.

In some embodiments, the fire-fighting system 100 can operate the UHPS 700 with a power take off (PTO) of the ARFF vehicle running at about 1800 revolutions per minute (RPM). The PTO can operate the UHPS 700 at about 40 to 50 horsepower (HP). In some embodiments, a transmission PTO can be used to drive the hydraulic supply pump 358. The transmission PTO can have greater torque capabilities than PTOs without a transmission. As a result, the transmission PTO can provide adequate power to drive the hydraulic supply pump 358 at a reduced power consumption. In some embodiments, the UHPS 700 can run at a pressure of at least 500 pounds per square inch (PSI). In some embodiments, the UHPS 700 can run at a pressure of about 1200 PSI to about 1800 PSI, or even up to about 2,000 PSI. Advances in the art can result in even higher pressures of the UHPS 700. In some embodiments, the FPS 300 can deliver the foamant up to about 20 GPM to the UHPS 700.

Also, the fire-fighting system 100 can operate the low-pressure system 600 at about 150 PSI using a PTO of about 800 RPM. The FPS 300 can deliver the foamant at a minimum flow rate of about 1.8 GPM to the low-pressure system 600. In some embodiments, the FPS 300 can be capable of injecting the foamant at a desired concentration in the range between 0.1% and 10% over a wide range of flow rates experienced in the fire-fighting system 100.

In some embodiments, the RPM of the PTO can be low enough to limit the heat generation of the fire-fighting system 100 and the overall wear of the ARFF vehicle. Because the ARFF vehicle can be subjected to extreme temperatures, the heat generation of the fire-fighting system 100 can be small enough to prevent overheating of the fire-fighting system 100, with conventional cooling methods.

In some embodiments, the ARFF vehicle itself can include the following components that are used in the fire-fighting system 100: suction and discharge piping, electrical hook-ups, a hydraulic cooler (e.g., with 567 BTU/min at 6.5 GPM capacity), a hydraulic reservoir (e.g., 15 gallons), and a PTO supplying sufficient power to operate the UHPS 700. The hydraulic cooler of the ARFF vehicle can be sufficient to additionally extract the generated heat of the fire-fighting system 100. The hydraulic cooler can be capable of maintaining a temperature of the hydraulic oil between about 140 degrees Fahrenheit to about 180 degrees Fahrenheit during operation. The hydraulic cooler can include a fan to extract heat. The hydraulic reservoir can be large enough to allow the fire-fighting system 100 to run at maximum capacity for an extended period of time while allowing air to settle out of the hydraulic oil.

In some embodiments, the pressure produced by the UHPS 700 can be high enough to reduce the size of the fire fighting system 100. As a result, the fire fighting system 100 can be installed on substantially smaller ARFF vehicles. Consequently, multiple ARFF vehicles can fit on a single cargo plane. Alternatively, loading and unloading of the ARFF vehicle onto and off the cargo plane can at least be facilitated and may not require disassembly of parts and/or releasing air of the tires of the ARFF vehicle.

In some embodiments, the UHPS 700 can be part of a residential fire truck. The UHPS 700 can lengthen the fire-fighting operation before water from a municipal source, like a fire hydrant, has to be used. The UHPS 700 can also enhance fire-fighting operations in remote locations, like wild fires. In some embodiments, the UHPS 700 can be mounted on an air vehicle. For example, a helicopter equipped with the UHPS 700 can extinguish fires on the upper floors of high-rise buildings. In other embodiments, stationary systems, like sprinkler systems of buildings, can include the UHPS 700.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A fire-fighting system comprising:

a water source;

a first pump drawing water from the water source at a first pressure;

a second pump drawing water downstream of the first pump at a second pressure higher than the first pressure, the second pressure being at least about 500 PSI;

a foam proportioning system including a foam tank with foamant and a high-pressure foam pump;

at least a first discharge line and a second discharge line, the first discharge line connected to an outlet of the first pump and at least one of a first turret and a first hand nozzle and the second discharge line connected to an outlet of the second pump and at least one of a second turret and a second hand nozzle, the first discharge line providing a first fluid path independent of a second fluid path of the second discharge line;

a first pressure relief valve in fluid communication with the second discharge line, the first pressure relief valve configured to route a portion of flow in the second fluid path back to the water source; and a second pressure relief valve in fluid communication with the high-pressure foam pump, the second pressure relief valve routing foamant back into the foam tank;

the first pump and the second pump being simultaneously operated in order to simultaneously discharge water from the at least one of the first turret and the first hand nozzle and the at least one of the second turret and the second hand nozzle to exit the fire-fighting system at different pressures.

2. The fire-fighting system of claim 1, and further comprising a flow meter positioned along at least one of the first discharge line and the second discharge line.

3. The fire-fighting system of claim 1, wherein the first pressure is from about 150 PSI to about 400 PSI and the second pressure is from about 1200 PSI to about 1800 PSI.

4. The fire-fighting system of claim 1, and further comprising a control system.

5. The fire-fighting system of claim 4, wherein the control system operates at least the foam proportioning system.

6. The fire-fighting system of claim 1, wherein the foam pump is hydraulically driven.

7. The fire-fighting system of claim 1, and further comprising a cleaning agent system.

8. The fire-fighting system of claim 1, and further comprising a compressed air foam system.

9. A fire-fighting system comprising:

a water source;

a low-pressure system connected to the water source and including a first discharge line providing a first fluid path and at least one of a first turret and a first hand nozzle;

an ultra-high pressure system delivering water at a pressure of at least 500 PSI and including a second discharge line providing a second fluid path, the second fluid path being independent of the first fluid path, the ultra-high pressure system further including at least one of a second turret and a second hand nozzle, the ultra-high pressure system connected to the low-pressure system, the low-pressure system and the ultra-high pressure system being simultaneously operated in order to simultaneously discharge water from the at least one of the first turret and the first hand nozzle at a first pressure and from the at least one of the second turret and the second hand nozzle at a second pressure;

a foam proportioning system including a foam tank and a high-pressure foam pump propelling a foamant from the foam tank into the low-pressure system and the ultra-high pressure system;

a first pressure relief valve in fluid communication with the second discharge line, the first pressure relief valve configured to route a portion of flow in the second fluid path back to the water source;

a second pressure relief valve in fluid communication with the high-pressure foam pump, the second pressure relief valve routing foamant back into the foam tank; and a control system providing for individualized foam flow rates in the low-pressure system and the ultra-high pressure system.

10. The fire-fighting system of claim 9, wherein the low-pressure system further includes a first pump and the ultra-high pressure system further includes at least a second pump.

11. The fire-fighting system of claim 9, wherein the low-pressure system further includes an inductor capable of sucking a foamant from the foam proportioning system into the low-pressure system.

12. The fire-fighting system of claim 9, and further comprising a flow meter positioned along at least one of the first discharge line and the second discharge line.

13. The fire-fighting system of claim 9, wherein the first pressure in the low-pressure system is from about 150 PSI to about 400 PSI and the second pressure in the ultra-high pressure system is from about 1200 PSI to about 1800 PSI.

14. The fire-fighting system of claim 9, wherein the control system operates at least the foam proportioning system.

15. The fire-fighting system of claim 9, further comprising a first pressure relief valve in fluid communication with the second discharge line, the first pressure relief valve routing a portion of flow in the second fluid path back to the water source.

16. The fire-fighting system of claim 9, further comprising a second pressure relief valve in fluid communication with the high-pressure foam pump, the second pressure relief valve routing foamant back into the foam tank.

17. The fire-fighting system of claim 5, wherein the control system provides for individualized foam flow rates in the first discharge line and the second discharge line.

18. The fire-fighting system of claim 17, wherein the control system includes an injector, the fire-fighting system further comprising:

a first flow meter in the first discharge line; and a second flow meter in the second discharge line;

the first flow meter and the second flow meter in electrical communication with the injector selector to providing for the individualized foam flow rates in the first discharge line and the second discharge line.

19. The fire-fighting system of claim 9, further comprising:

a first pressure relief valve in fluid communication with the ultra-high pressure system, the first pressure relief valve configured to route a portion of flow back to the water source.

20. A fire-fighting system comprising:

a water source;

a low-pressure system connected to the water source and including a first discharge line providing a first fluid path and at least one of a first turret and a first hand nozzle;

an ultra-high pressure system delivering water at a pressure of at least 500 PSI and including a second discharge line providing a second fluid path, the second fluid path being independent of the first fluid path, the ultra-high pressure system further including at least one of a second turret and a second hand nozzle, the ultra-high pressure system connected to the low-pressure system, the low-pressure system and the ultra-high pressure system being simultaneously operated in order to simultaneously discharge water from the at least one of the first turret and the first hand nozzle at a first pressure and from the at least one of the second turret and the second hand nozzle at a second pressure;

a foam proportioning system including a foam tank and a high-pressure foam pump propelling a foamant from the foam tank into the low-pressure system and the ultra-high pressure system; and a control system providing for individualized foam flow rates in the low-pressure system and the ultra-high pressure system;

a first pressure relief valve in fluid communication with the ultra-high pressure system, the first pressure relief valve configured to route a portion of flow back to the water source;

a second pressure relief valve in fluid communication with the high-pressure foam pump, the second pressure relief valve routing foamant back into the foam tank.

21. The fire-fighting system of claim 20, wherein the control system further includes an injector selector, the fire-fighting system further comprising:

a first flow meter in the first discharge line; and a second flow meter in the second discharge line;

the first flow meter and the second flow meter in electrical communication with the injector selector to providing for the individualized foam flow rates in the first discharge line and the second discharge line.

22. A fire-fighting system comprising:

a water source;

a first pump drawing water from the water source at a first pressure;

a second pump drawing water downstream of the first pump at a second pressure higher than the first pressure, the second pressure being at least about 500 PSI;

a foam proportioning system including a foam tank with foamant and a high-pressure foam pump;

at least a first discharge line and a second discharge line, the first discharge line connected to an outlet of the first pump and at least one of a first turret and a first hand nozzle and the second discharge line connected to an outlet of the second pump and at least one of a second turret and a second hand nozzle, the first discharge line providing a first fluid path independent of a second fluid path of the second discharge line;

a first flow meter in the first discharge line and a second flow meter in the second discharge line;

a control system including an injector selector, the first flow meter and the second flow meter in electrical communication with the injector selector providing for individualized foam flow rates in the first discharge line and the second discharge line;

a first pressure relief valve in fluid communication with the second discharge line, the first pressure relief valve configured to route a portion of flow in the second fluid path back to the water source; and a second pressure relief valve in fluid communication with the high-pressure foam pump, the second pressure relief valve routing foamant back into the foam tank.

23. The fire-fighting system of claim 22, wherein the high-pressure foam pump sends a speed signal to the control system, and the control system changes the speed of the high-pressure foam pump.

24. The fire-fighting system of claim 22, wherein the first flow meter is positioned upstream of a foamant intake on the first discharge line and the second flow meter is positioned upstream of a foamant intake on the second discharge line such that a flow rate in the first discharge line and a flow rate in the second discharge line are based on water.

* * * * *